US006396448B1

(12) United States Patent
Zimmerman et al.

(10) Patent No.: US 6,396,448 B1
(45) Date of Patent: May 28, 2002

(54) SCANNING DIRECTIONAL ANTENNA WITH LENS AND REFLECTOR ASSEMBLY

(75) Inventors: Kurt Alan Zimmerman, Indialantic, FL (US); John Elliott Wann, Dacula, GA (US); Robert Alan Freeman, Norcross, GA (US); Donald Nelson Black, Jr., Duluth, GA (US); James Charles Marsik, Loganville, GA (US)

(73) Assignee: EMS Technologies, Inc., Norcross, GA (US)

( * ) Notice: Subject to any disclaimer, the term of this patent is extended or adjusted under 35 U.S.C. 154(b) by 0 days.

(21) Appl. No.: 09/638,602

(22) Filed: Aug. 15, 2000

Related U.S. Application Data

(60) Provisional application No. 60/149,331, filed on Aug. 17, 1999.

(51) Int. Cl.[7] ..... H01Q 19/06

(52) U.S. Cl. ..... 343/753; 343/754; 343/757; 343/766; 343/911 R

(58) Field of Search ..... 343/753, 754, 343/757, 762, 763, 766, 772, 911 R, 911 L

(56) References Cited

U.S. PATENT DOCUMENTS 3,602,720 A * 8/1971 Hagood ..... 333/73 W
4,283,685 A * 8/1981 MacMaster et al. ..... 330/286
4,670,754 A * 6/1987 Zacchio ..... 342/124
5,121,129 A * 6/1992 Lee et al. ..... 343/753
5,764,199 A 6/1998 Ricardi ..... 343/911
5,781,163 A 7/1998 Ricardi et al. ..... 343/911
6,204,822 B1 * 3/2001 Cardiasmenos et al. .... 343/761

* cited by examiner

*Primary Examiner*—Don Wong
*Assistant Examiner*—Shih-Chao Chen
(74) *Attorney, Agent, or Firm*—King & Spalding

(57) ABSTRACT

An antenna comprising a feed for delivering electromagnetic energy to a rotatable combination of a dielectric lens and a reflective surface. The combination of the dielectric lens and the reflective surface is placed proximate to and in front of an energy feed, such as a horn, to support the scanning of an antenna beam in response to rotation of the lens/reflective surface assembly. The lens typically comprises a dielectric material and the reflective surface can comprise a thin layer of material operable to reflect electromagnetic energy. For example, the lens can comprise a half-cylinder shape of dielectric material and the reflective surface can be applied to the flat portion of the half-cylindrical lens. Alternatively, the antenna can comprise two or more electromagnetic feeds and a cylindrical lens of dielectric material including a centrally-embedded, two-sided reflective surface. A positioning system can be used to rotate the combination of the lens and the reflective material proximate to and in front of the electromagnetic feed(s).

20 Claims, 12 Drawing Sheets

| THETA | L |
|---|---|
| 45 | 1.41H |
| 60 | 2H |
| 75 | 3.9H |

ELEVATION BEAM SCANNED TO =30 DEGS
MIRROR SCANNED 15 DEG'S FROM VERTICAL

ELEVATION BEAM SCANNED TO =90 DEGS
MIRROR SCANNED 45 DEGREES FROM VERTICAL

SCANNING DIRECTIONAL ANTENNA WITH LENS AND REFLECTOR ASSEMBLY

RELATED APPLICATION

This non-provisional patent application claims priority under 35 U.S.C. § 119 to the filing date assigned to the related provisional patent application, Ser. No. 60/149,331, filed on Aug. 17, 1999.

TECHNICAL FIELD

The present invention is generally directed to a mechanically-scanned directional antenna. More particularly described, the present invention is a scanning beam antenna using a rotatable combination of a lens and a reflective surface, such as a mirror, to scan a wide field-of-view.

BACKGROUND OF THE INVENTION

Omnidirectional antennas cover a 360 degree field-of-view with a single beam. A directional antenna with a narrow azimuth beamwidth can be used to increase gain or provide directional information. For example, a 10 degree, half-power beamwidth antenna will have approximately 15 dB more gain than an "omni" antenna with the same elevation beamwidth. FIGS. 1A and 1B emphasize this gain difference and illustrate the use of multiple narrow beams to maintain antenna coverage over a 180 degree field-of-view. As shown in FIGS. 1A and 1B, an antenna characterized by a narrow azimuth beam 14 of 10 degrees typically exhibits an increased gain when compared to a typical pattern 12 for an omnidirectional antenna. To obtain this desirable gain increase of a directional antenna over a wide field-of-view, multiple narrow azimuth beams 16 can be mechanically or electronically scanned to cover a 180 degree field-of-view.

Scanned antennas are typically implemented in one of two forms: electronic scan or mechanical scan. Electronically-gained antennas usually require beam forming networks which contain electronic RF switches or phase control devices. Mechanically-scanned antennas typically utilize a motor to rotate or position a directional antenna in different directions over the required field-of-view. Mechanically-scanned antennas are usually less expensive to construct than electronically-scanned antennas but have slower scanning ability and lower reliability due to the use of moving parts.

FIG. 2 illustrates an antenna with a typical reflecting mirror for scanning a narrow beam. Mirrored reflectors have been used to scan narrow beams over a small field-of-view. RF energy is normally collimated off the mirror, which can create spill-over loss if the mirror is tilted by a large angle. As shown in FIG. 2, a flared horn can emit an electromagnetic signal that is reflected by a reflecting surface, such as a mirror 22, to direct electromagnetic energy away from the antenna transmission axis. By rotating tie mirror 22 proximate to the output slot of the flared horn 20, the electromagnetic energy can be scanned over a relatively small field-of-view. Angle theta defines the angle between the mirror 22 and the reflection axis for the beam B reflected by the reflective surface of the mirror. To reflect electromagnetic energy from the reflective surface of the mirror 22 at an angle theta, the length L of the mirror 22 is defined by the ratio of the horn span H and the angle theta. The length of the mirror 22 is defined by Equation 1, as follows:

$$\frac{H}{\cos(\text{theta})} \qquad \text{Equation 1}$$

For example, if the angle theta is 45 degrees, then the length L is defined by 1.41×H. If the angle theta is 60 degrees, then the length L is defined by 2.0×H. If the angle theta is 75 degrees, then the length L is defined by 3.9×H.

Mechanical tracking antennas typically use motor-driven rotation with position knowledge or feed-back and can be commanded to point and dwell from one beam position to the next beam position. If the user application requires repetitive rapid scans of the same field-of-view, most mechanically-scanned antennas lose efficiency by decelerating at the end of the scan to allow a subsequent acceleration in the reverse direction. In addition to time inefficiency in reversing the angular momentum, the reverse rotation adds cost and complexity to the positioning system and causes wear and stress on the bearing and joints of the positioning system.

As shown in FIG. 3, a simpler and lower-cost tracking approach is provided by a continuous rotating, mechanically-scanned system. A horn antenna 32 can be rotated about a transmission axis by an RF rotary joint 34 driven by a motor 36. The rotation of the horn antenna 32 results in the sang of a narrow beam along a predetermined field-of-view. For example, to scan a 180 field-of-view with a 10 degree bean in the azimuth plane, the horn antenna 32 can be rotated in accordance with Option 1 by reversing the direction of the scan based upon deacceleration and acceleration operations completed by the RF rotary joint 34 and the motor 36. In the alternative, a horn 32 can be rotated to produce a continuous scan of the narrow beam in accordance with Option 2, thereby resulting in "dead" time when the desired antenna coverage is 180 degrees. Although Option 2 has the advantage of re-scanning in the same direction, a recovery period results from the motion of the antenna when the desired antenna coverage is less than 360 degrees. The latency in revisiting a specific pointing direction is undesirable in a collision warning radar or missile detecting radar due to the closure movement of the target while a continuous rotating antenna is in the recovery period of its rotation. Recovery time can be reduced by faster antenna rotation but this increases cost, reduces reliability, and reduces the "dwell" time on the target due to the high angular rotation rate.

In view of the foregoing, there is a need in the art for an improved antenna that can efficiently scan an antenna beam over a wide field-of-view. Moreover, there is a need in the art to provide a mechanically-scanned antenna that can scan a narrow beam over a wide field-of-view in a reliable manner without the need for a complex positioning system. There is a further need in the art for a mechanically-scanned directional antenna that exhibits a near instantaneous reset or "fly-back" capability for applications requiring the re-scanning of a specific pointing direction. The present invention addresses these and other needs in the art by providing an antenna comprising at least one feed with a rotating dielectric lens having a reflective surface, such as a mirror, to scan a narrow beam over a relatively wide field-of-view.

SUMMARY OF THE INVENTION

The present invention addresses the needs of the prior art by achieving the desired characteristics of a low-cost, mechanically-scanned antenna with the high reliability and near instantaneous reset or "fly-back" capability of an electronically-scanned antenna. The present invention provides a low cost, reliable, mechanically-scanned directional antenna that can scan a wide field-of-view by rotating a reflecting lens/mirror assembly placed adjacent to a signal source. By keeping the signal source, such as a line source, stationary and scanning a lens/mirror assembly, the need for RF rotary joints or flexible transmission line and amplifier slip rings is eliminated for the antenna design. The lens can be implemented as one-half of a constant-K dielectric cylinder with a reflective surface or mirror, such as metal foil tape, applied to the flat portion of the lens. For example, a parallel-plate horn can scan 180 degrees of the azimuth plane by rotating a lens/mirror assembly positioned proximate to the horn output slot and within the transmission axis for the antenna beam. Installing a second half cylinder lens on the back side of this mirror can support the generation of two or more directional beams, thereby achieving a simultaneous scan of 360 degrees with the use of a pair of opposing horns. Switching the output of a single transceiver between two or more horns allows a "fly-back" re-scan capability.

In general, the present invention provides an antenna comprising a feed for delivering electromagnetic energy and a rotatable combination of a dielectric lens and a reflective surface. The combination of the dielectric lens and reflective surface, also described as a reflecting lens/mirror, is placed proximate to and in front of the energy feed. This supports the reflection of electromagnetic energy as the reflecting lens/mirror rotates over a predetermined range to scan the resulting beam within a desired field-of-view. For one aspect of the present invention, the energy feed is provided by a parallel-plate horn and the dielectric lens has a half-cylinder shape. The reflective surface is typically placed adjacent to the flat surface of the half-cylindrical lens to form the reflecting lens/mirror assembly. The cylindrical portion of the lens can face the energy feed, thereby separating the reflective surface positioned along the flat surface of the lens from the energy source by slightly more than the radius of the lens. The reflecting lens/mirror assembly can be rotated about the energy source by a mechanical rotating mechanism, such as a motor coupled to a belt-drive. By rotating the reflecting lens/mirror assembly over a range of 90 degrees, the parallel-plate horn can scan a narrow beam over a range of approximately 180 degrees. The antenna scan rate and angular movement is twice the rotation rate/movement of the lens/mirror.

For another aspect of the present invention, a second half-cylinder lens can be placed adjacent to the rear of the reflective surface to form a cylindrical lens comprising a reflective surface positioned between a pair of half-cylinder lens. Two or more energy feeds, such as horn antennas, can be positioned proximate to this, rotatable combination of cylindrical lens and a reflective surface to provide two or more directional beams that scan a wide field-of-view in response to rotation of the cylindrical lens/reflective surface assembly. A switch can be used to switch a signal source between two or more energy feeds to enable a "fly-back" re-scanning operation.

That the invention provides an antenna comprising an energy feed and the rotatable combination of a lens and a reflective surface will become apparent from the following detailed description of the exemplary embodiments and the appended drawings.

DETAILED DESCRIPTION OF DRAWINGS

DETAILED DESCRIPTION OF THE EXEMPLARY EMBODIMENTS

Figure 1A:
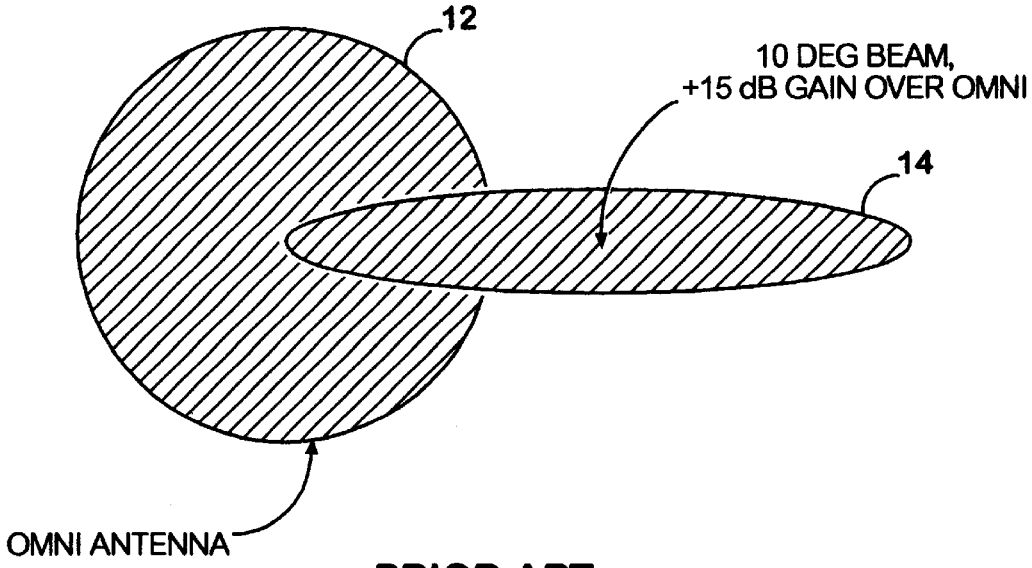
PRIOR ART FIG.1A
FIGS. 1A and 1B are general illustrations of the higher gain and limited angular coverage area achieved by a narrow beam antenna when compared to an omni antenna.
Figure 1B:
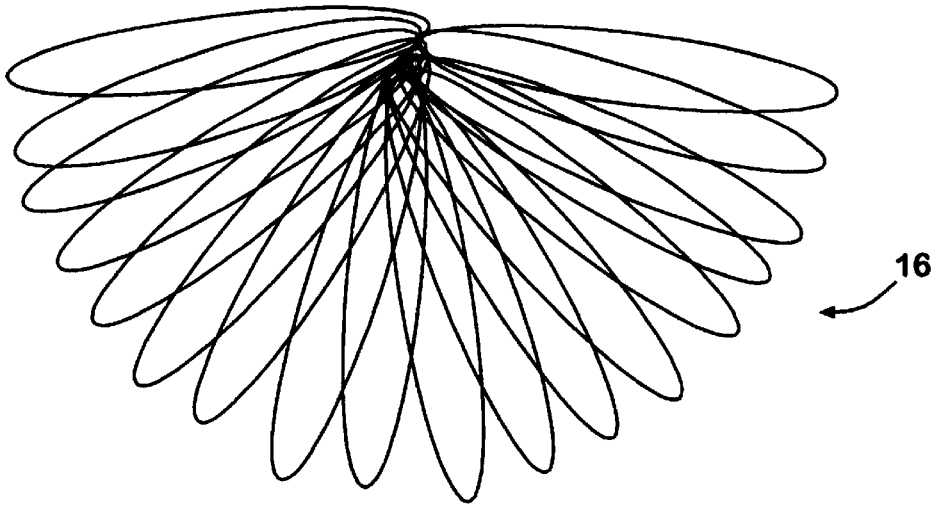
PRIOR ART FIG.1B
Figure 2:
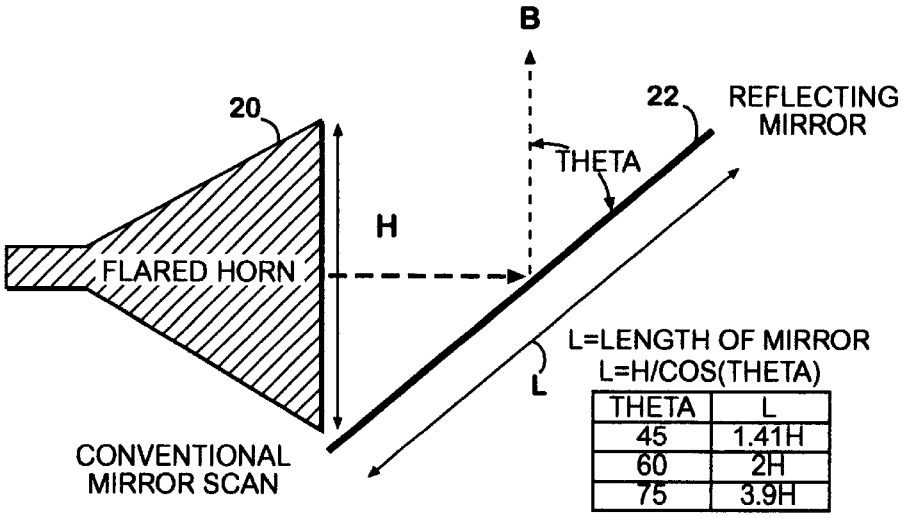
PRIOR ART FIG.2
FIG. 2 is a diagram that shows the combination of a flared horn with a conventional flat-plate mirror.
Figure 3:
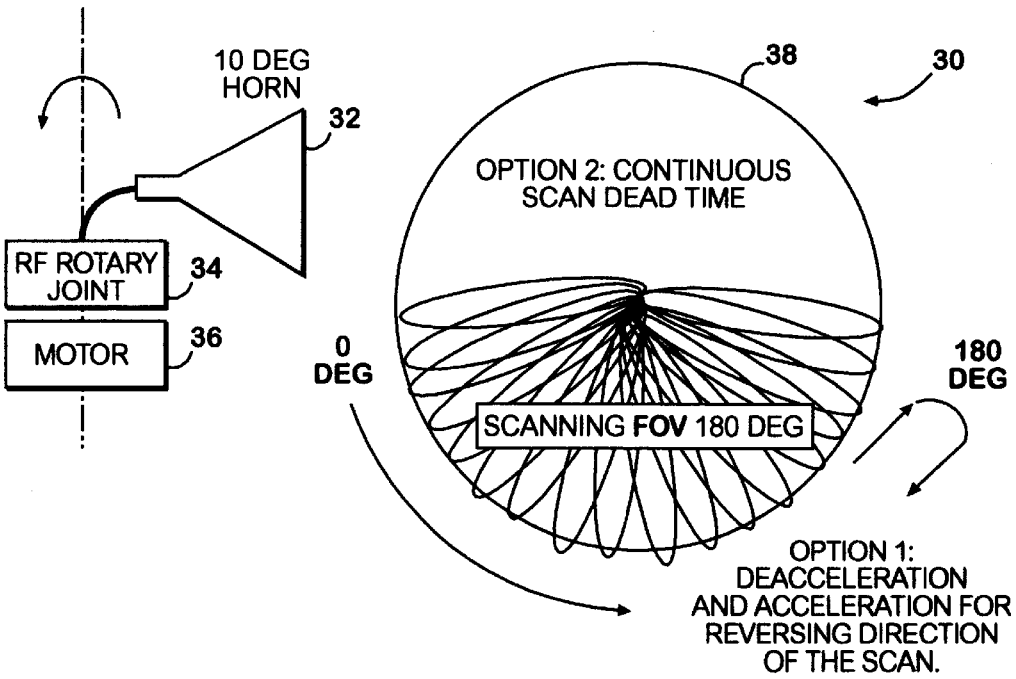
PRIOR ART FIG.3
FIG. 3 is a diagram that shows the combination of a scanning horn with a constant RPM motor and an RF rotary joint.

Generally stated, the present invention utilizes a rotating dielectric lens/mirror comprising a half-cylinder lens or a cylindrical lens and a reflective surface as a phase collimator for a directional beam and scanning device. By adding a second feed, an RF switch and a continuous rotating motor, a scanning antenna can cover an 180 degree field-of-view with instant reset or fly-back. By rotating the half-cylinder lens with a mirror applied to the flat surface of the lens, the spill-over losses of a conventional scanning mirror-plate antenna are reduced and the mirror size is minimized. Extending the number of feeds, extruding a dielectric lens, and using staggered mirrors can reduce the field-of-view while maintaining instant reset capability with a single constant RPM motor. The diameter for a cylindrical lens can be used to set the antenna beamwidth in the rotating plane. The feed source can be a waveguide horn or an array of dipole elements fed by a power divider.

Use of a reflective surface, such as a mirror, doubles the antenna beam rotation relative to the mirror/lens rotation. For example, 90 degrees of lens/mirror rotation can result in rotation of the antenna beam by 180 degrees. Likewise, a range of 0 to 90 degrees of coverage can be achieved with only 45 degrees of lens/mirror coverage. This design provides an ideal candidate for a low-profile, mobile satellite terminal where one-half of a cylindrical lens can be used with a mirror in a horizontal orientation to provide 15 to 90 degree elevation coverage on top of a 360 degree, rotating azimuth turn-table. The lens/mirror position can be controlled by a rotary positioning system, such as an open-loop, stepper motor or servomotor with position feed-back.

An exemplary embodiment can rotate a cylindrical dielectric lens having an embedded two-sided reflective surface to support the scanning of a field-of view with half the latency of a simple scanning horn. By using two active horns, any angular direction over a range of 360 degrees can be visited by a beam 4 times during a single rotation of this lens/mirror assembly. Using two horns with a switch matrix allows updating a 180 degree field-of-view 4 times per lens/mirror rotation without any "dead" time. Latency is further reduced by the ability for beams to fly-back from the end of a 180 degree scan to the beginning of the scan at the speed of the RF switch. This switching time can be milliseconds with a mechanical switch, microseconds with a ferrite-switching circulator, or nanoseconds with a RF diode switch. By using 4 active horns, any angular direction in 360 degrees can be updated 8 times per rotation of the lens/mirror assembly. Adding a switch matrix allows scanning a 90 degree field-of-view 8 times for a single rotation of the lens/mirror assembly.

The incorporation of two feeds, 180 degrees opposed to each other and connected by a electronic RF switch, allows a near instantaneous reset of the beam back to its original position by switching between horn A and horn B. This allows a constant RPM motor to be used and eliminates the recovery period normally associated with constant scanning antennas. The 180 degree field-of-view can be scanned four times for a single rotation of the lens/mirror assembly.

The two-feed design can be extended to four feeds by placing an additional feed on each side of the rotating lens/mirror assembly. This allows a 90 degree field-of-view to be continuously scanned with a constant RPM motor and zero dead-time. "Instant" restart or fly-back is accomplished by switching between the four horns.

In general, for any field-of-view, the number of feeds is given by Equation 2, as follows:

$$N_{feed}=360/FOV \qquad \text{Equation 2}$$

For example, for a field-of-view (FOV) of 180 degrees, a pair of feeds, such as horn antennas, are required for use in connection with the combination of a lens and a reflective surface. A field-of-view of 120 degrees requires three feeds.

One lens for every feed and one mirror is required to achieve continuous coverage with a constant RPM scanning motor. Each mirror is preferably staggered in orientation by half of the field- of-view. For even number feeds, 180°, 90°, 45°, etc., both sides of the mirror can be used and half of the feeds are mounted opposite each other.

Figure 4A:
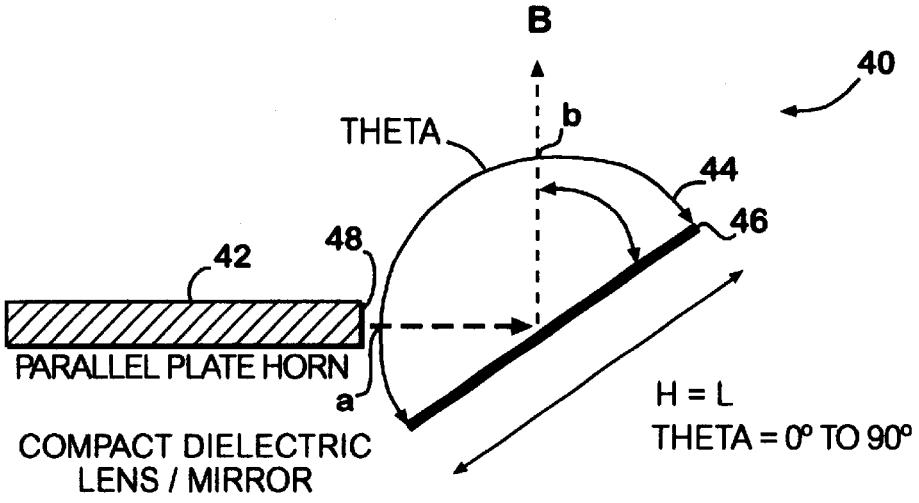
FIG. 4A is a diagram illustrating a parallel-plate horn and a combination of a dielectric lens and a reflective surface in accordance with an exemplary embodiment of the present invention.

Turning now to FIG. 4A, an exemplary antenna 40 comprises a line source, such as a parallel-plate horn 42, a half-cylinder of dielectric material forming a lens 44, and a reflective surface 46 positioned adjacent to the flat surface of the lens 44. The horn antenna is preferably implemented as a flared horn including a front opening or slot 48 extending across the mouth of the horn 42 for radiating electromagnetic energy. The slot 48 forms an aperture assigned a width H. The horn 42 is oriented substantially parallel to the axis of the semi-cylindrical shape of the lens 44.

The lens 44, which typically comprises a constant-K dielectric material, has a half-cylindrical shape. The curved, semi-cylindrical surface of the lens 44 faces the slot 48, thereby separating the reflective surface 46 from the slot 48 by slightly more than the radius of the lens 44. The reflective surface 46 operates as a mirror and can be implemented as a thin layer of metallic foil tape applied to the flat surface of the lens 44. The flat surface of the semi-cylindrical lens 44 is coincident with the axis of the semi-cylinder and the curved semi-cylindrical surface is centered upon that axis. The reflective surface 46 is positioned adjacent to the flat side of the lens 44 and faces the curved semi-cylindrical surface of the lens. The length L of the reflective surface 46 is preferably equal to the width H of the slot 48. The center point of the lens 44 is preferably positioned along the transmission axis of the horn 42 to support the efficient reflection of electromagnetic energy output by the horn 42 and passing through the dielectric material of the lens 44 to reach the reflective surface 46. For example, the antenna beam output by the parallel plate horn 42 can enter the dielectric lens 44 at position "a", reflect off of the reflection surface 46, and exit the lens 44 at a position "b". The parallel plate horn 42 can include a sub-feed comprising a dielectric lens (not shown) to focus electromagnetic energy along the transmission axis and upon the lens 44 for reflection off of the reflective surface 46. This sub-feed lens is typically placed within the interior of the parallel plate horn.

The combination of the lens 44 and the reflective surface 46, otherwise described as a reflecting lens/mirror assembly, can be rotated in front of the slot 48 by a mechanical means (not shown), such as a constant RPM motor, to rotate the antenna beam about a selected field-of-view. Consequently, the electromagnetic energy output by the horn slot 48 travels along the transmission axis, through the dielectric material of the half-cylinder lens 44, reflects off of the reflective surface 46, and passes through the dielectric material of the lens 44 along a reflection axis to generate the antenna beam in a desired position. Angle "theta", which extends between the reflective surface 46 and a reflection axis, defines a field of rotation for the reflecting lens/mirror assembly. For example, for an angle "theta" of 90 degrees, the energy output by the horn antenna is reflected by the reflective lens/mirror assembly by 180 degrees. Similarly, a coverage range of 0 to 90 degrees can be achieved by rotating the lens/mirror assembly over only 45 degrees.

Figure 4B:
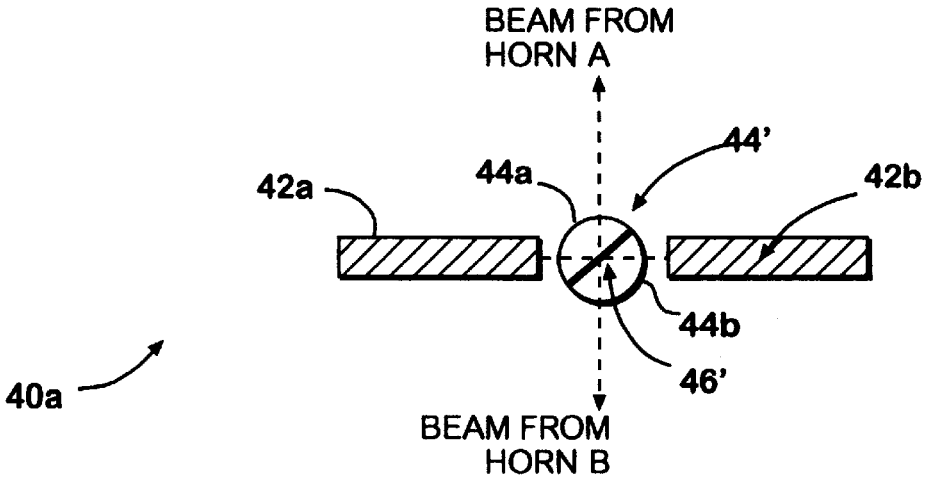
FIGS. 4B and 4C are top and front views, respectively, of a cylindrical dielectric lens including a reflective surface placed between a pair of parallel-plate horns in accordance with an alternative embodiment of the present invention.
Figure 4C:
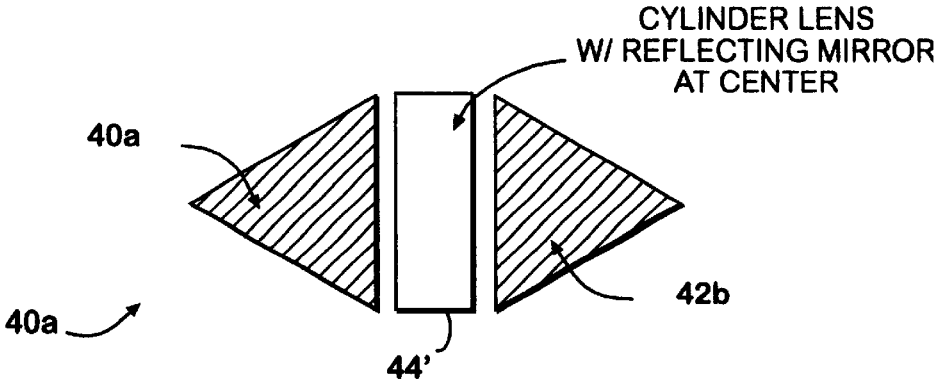

FIGS. 4B and 4C present top and front views, respectively, of an alternative embodiment of the present invention. Referring now to FIGS. 4B and 4C, an exemplary antenna 40*a* comprises a pair of horns 42*a* and 42*b* and a cylindrical lens 44' including a pair of half-cylinder lens 44*a* and 44*b* separated by a reflective surface 46'. The horns 42*a* and 42*b* operate as feeds and are preferably placed on opposite sides of the lens 44' and oriented substantially parallel to the axis of the cylinder. The horns 42*a* and 42*b* emit electromagnetic energy along a transmission axis that extends into the lens 44' and intersects the approximate center point of the reflective surface 46'. Each half-cylinder lens 44*a* and 44*b*, alternatively described as a lens having the form of a semi-cylinder, preferably comprises a constant-K dielectric material that allows the passage of electromagnetic energy. The reflective surface 46' preferably comprises a reflective material, such as a two-sided metal foil or a mirror that can be embedded within the cylinder 44'. In particular, the reflective surface 46' is placed adjacent to the flat surface of each of the half cylinder lens 44*a* and 44*b* to present a reflective surface to both lens of the cylindrical lens 44'. The reflective surface 46' is preferably positioned within the central portion of the cylinder 44' and extends along the central axis of the cylinder.

The lens 44' can be rotated by a mechanical means, such as a constant RPM motor, to cover a rotation range of 360 degrees. Rotation of the cylindrical lens 44' between the horns 42*a* and 42*b* results in the generation of multiple beams that cover an omnidirectional pattern of 360 degrees. The 360 degree scanning range is achieved by the reflection of electromagnetic energy from the reflective surface 46' in response to rotation of the pair of half cylinder lenses 44*a* and 44*b* between the horns 42*a* and 42*b*. This allows the antenna 40*a* to achieve the benefit of increased gain associated with a relatively narrow beamwidth, when compared to a conventional omnidirectional antenna.

Figure 4D:
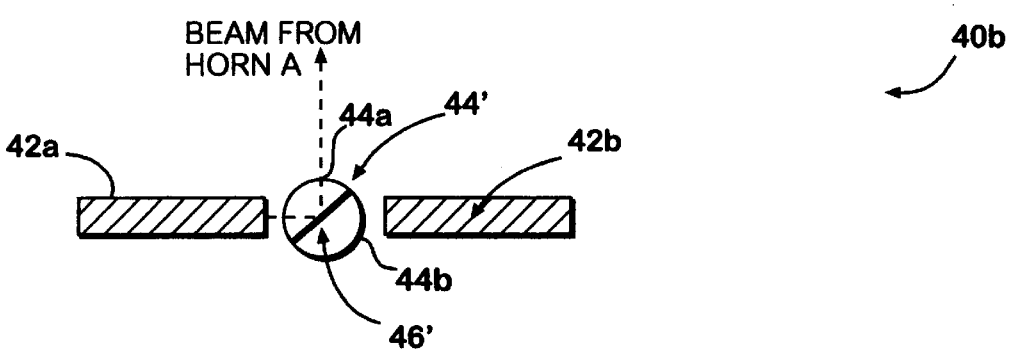
FIGS. 4D and 4E are top and front views, respectively, of the exemplary antenna embodiment shown in FIGS. 4B and 4C and a switch for selectively controlling the delivery of energy to the horns in accordance with an alternative exemplary embodiment of the present invention.
Figure 4E:
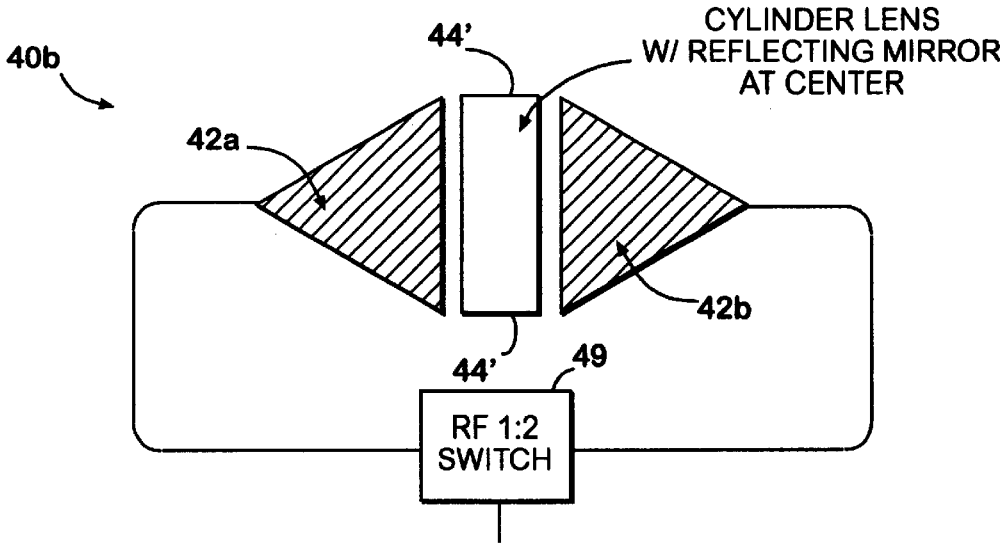

FIGS. 4D and 4E provide top and front views, respectively, of an exemplary antenna 40*b* that is similar to the exemplary antenna 40*a*, with the exception of the addition of an RF switch connected to a signal source (not shown) for controlling the distribution of electromagnetic energy to either one of the pair of horns 42*a* and 42*b*. As briefly described above, an electronic RF switch allows an almost instantaneous reset of the beam to its original position by switching the distribution of electromagnetic energy between horns 42*a* and 42*b* while the cylindrical lens 44' is rotating between the horns. It will be appreciated that a scanning range of 180 degrees can be achieved by rotating the lens 44' in front of an active horn 42*a*, whereas the remaining 180 degrees of scanning coverage results from rotating the cylindrical lens 44' in front of the active horn 42*b*. The reflective surface 46', also described as a reflecting mirror, is exposed to either a beam output by the horn 42*a* or the horn 42*b* because the switch 49 directs electromagnetic energy to only one of the horns at any particular time interval.

Figure 5A:
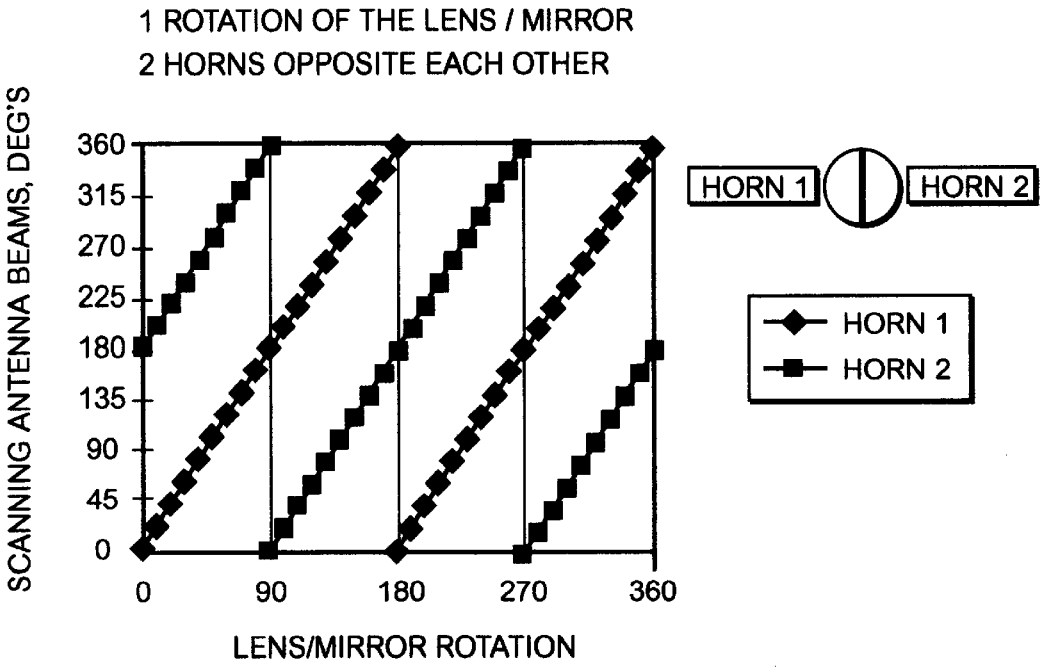
FIGS. 5A and 5B are diagrams that show scanning plots for exemplary antenna embodiments using two horns and a rotating lens/mirror.
Figure 5B:
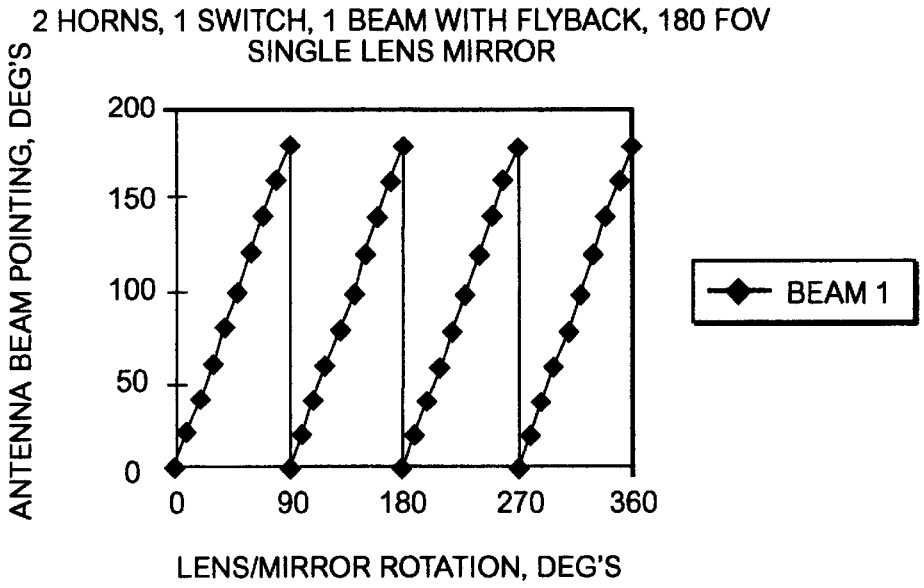

FIGS. 5A and 5B provide diagrams that illustrate the field-of-view achieved by rotation of a lens/mirror assembly between a pair of opposing horns. For both FIGS. 5A and 5B, the lens/mirror assembly comprises a pair of half-cylinder dielectric lens that are placed adjacent to a flat reflective surface to form a cylindrical lens having a centrally-embedded, two-sided reflective surface. As shown in FIG. 5A, any angular direction in 360 degrees can be visited by an antenna beam four separate times during a single rotation of the lens/mirror assembly between opposing horns. For example, the beam is generated at the angular direction of 90 degrees by the first horn when the lens/mirror assembly is set to 135 degrees or 315 degrees. A beam is also generated at the angular direction of 90 degrees by the second horn when the lens/mirror assembly is set to 45 degrees and 215 degrees. FIG. 5A also illustrates that a single rotation of the lens/mirror assembly between a pair of opposing horns can scan an antenna beam about a 360 degree field-of-view in response to rotating the lens/mirror assembly over a range of 180 degrees.

By switching the distribution of electromagnetic energy between the pair of opposing horns, the lens/mirror assembly can scan a single beam across a 180 degree field-of-view with near instantaneous fly-back capability. Turning now to FIG. 5B, a single beam can scan a 180 degree field-of-view based upon a rotation of the lens/mirror assembly over a range of 90 degrees. For example, this exemplary antenna can generate a single beam at the angular direction of 90 degrees when the lens/mirror assembly is set to 45 degrees, 135 degrees, 225 degrees, and 315 degrees.

Figure 6:
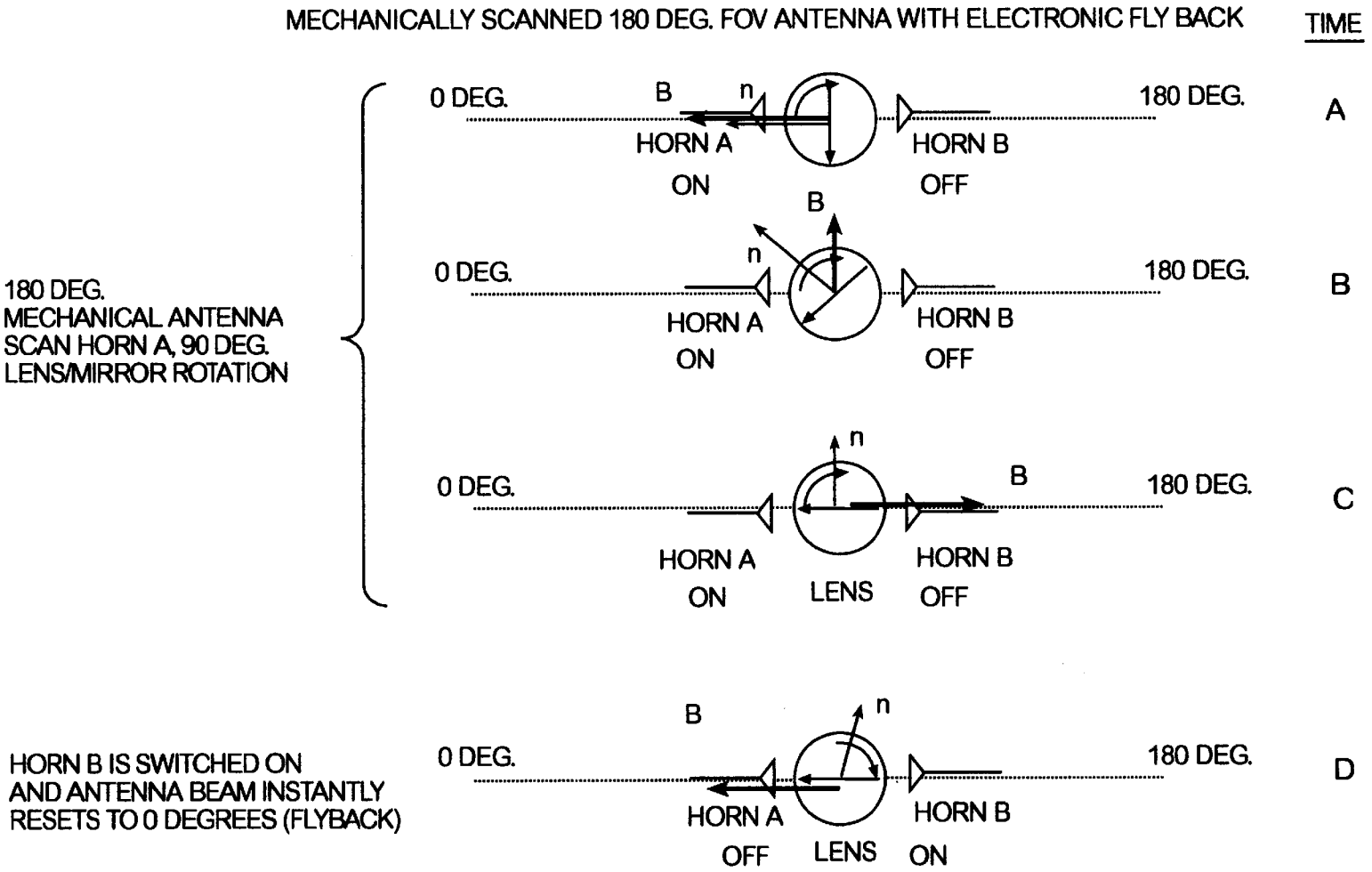
FIG. 6 is a diagram that shows the near instantaneous reset or fly-back operation of an exemplary antenna embodiment using two horns and a lens/mirror with a switch matrix in accordance with an exemplary embodiment of the present invention.

FIG. 6 provides another illustration of the near instantaneous reset or "fly-back" operation that can be achieved by switching the distribution of electromagnetic energy between a pair of opposing horns while a lens/mirror assembly is rotating between the horns. Similar to the lens/mirror assembly described above with respect to FIGS. 5A and 5B, a reflective surface is centrally-embedded along the axis of a cylindrical lens of dielectric material and rotated between the opposing horns by a positioning system. Operation of the exemplary antenna is initiated by controlling the switch to direct electromagnetic energy to horn A. At time A, the lens/mirror assembly is set to 0 degrees and the exemplary antenna generates a single beam B at the angular direction of 0 degrees. At time B, the lens/mirror assembly has rotated to an angular direction of 45degrees, which results in the generation of a single beam B at the angular direction of 90 degrees. At time C, the lens/mirror assembly has rotated to 180 degrees, thereby resulting in the generation of a beam B at the angular direction of 180 degrees. However, at time D, distribution of electromagnetic energy is switched by a switch command from horn A to horn B while the lens/mirror assembly is set to 180 degrees. This results in the generation of a single beam B at an angular direction of 0 degrees, thereby resetting the antenna beam to an angular direction previously visited at time A when horn A was active.

Those skilled in the art will appreciate that some degradation of antenna gain may occur at approximately time A due to self-blockage and the initial scan position. It will also be understood that a high sidelobe condition can exist at approximately time C upon reaching the endpoint of the scan.

Figure 7A:
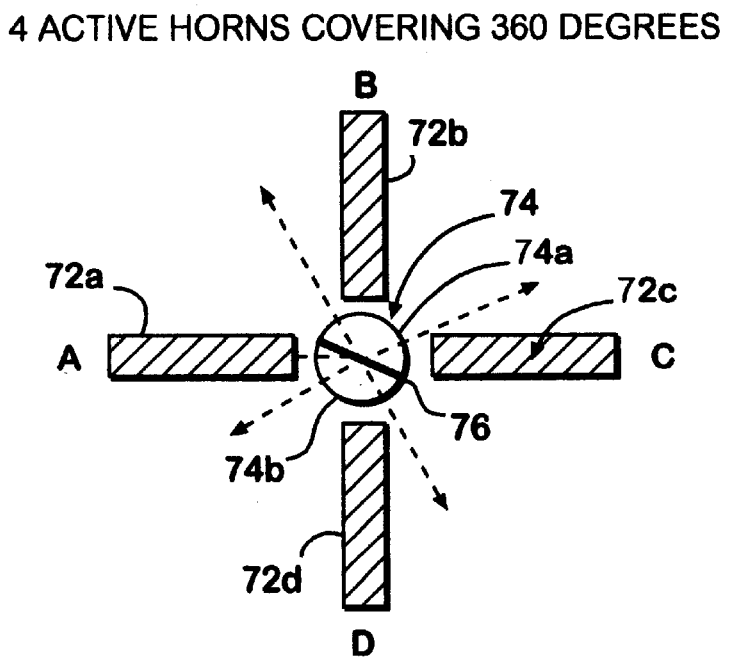
FIGS. 7A and 7B are top and front views, respectively, of a cylindrical dielectric lens positioned between four parallel-plate horns in accordance with an exemplary embodiment of the present invention.
Figure 7B:
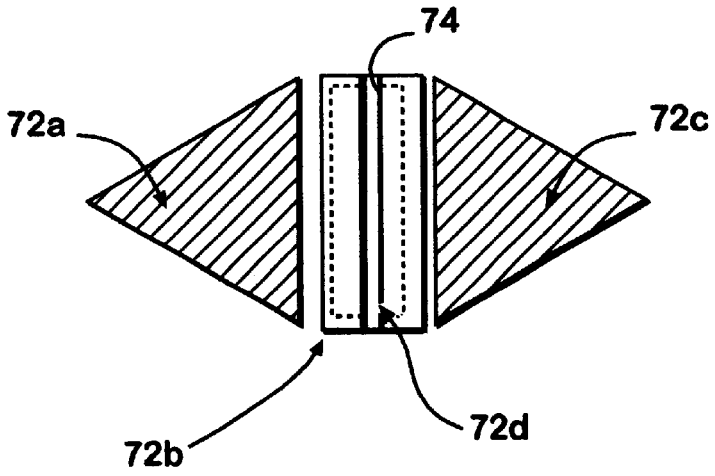
Figure 7C:
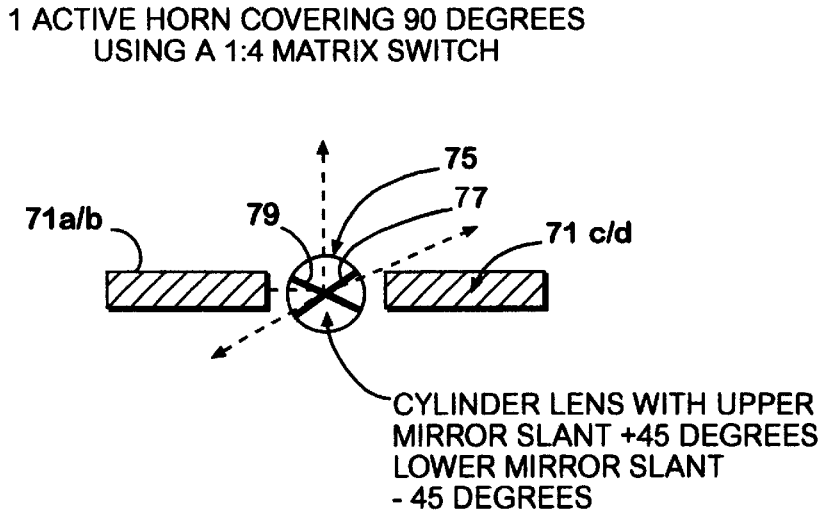
FIGS. 7C and 7D are top and front views, respectively, of an exemplary antenna including four horns, a cylindrical dielectric lens and a switching matrix for controlling the delivery of energy to any one of the four horns, in accordance with an exemplary embodiment of the present invention.
Figure 7D:
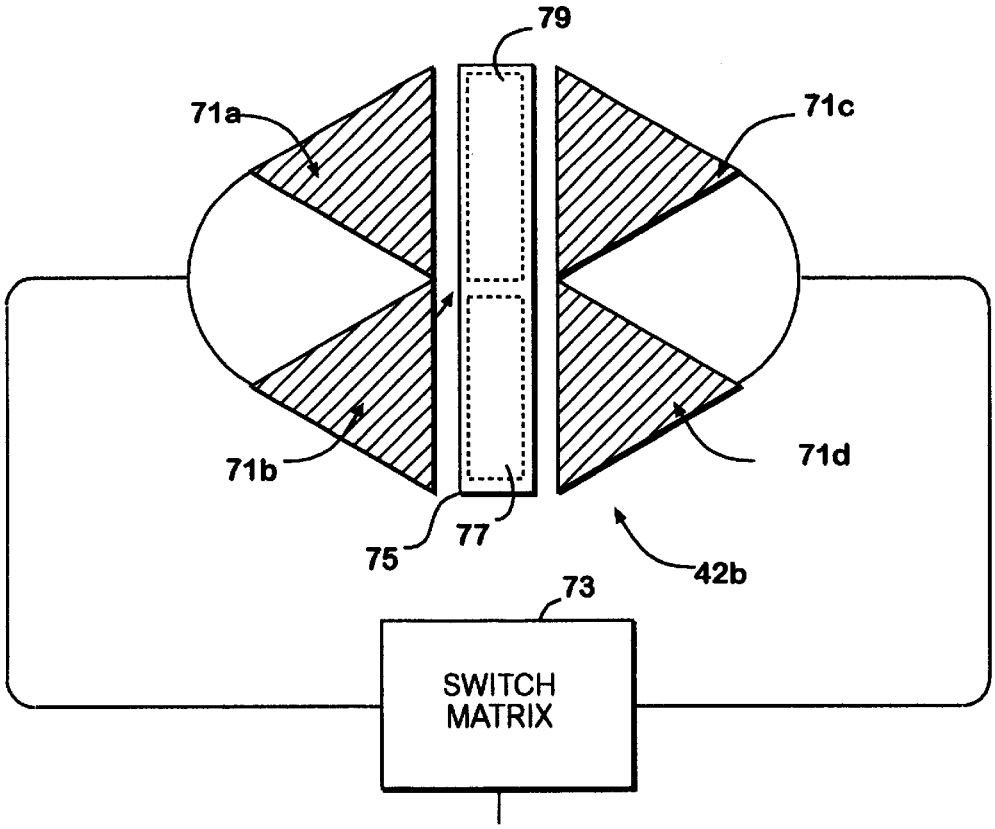

FIGS. 7A and 7B provide top and front views, respectively, of an exemplary antenna comprising four horns and a lens/mirror assembly comprising a cylindrical lens having a centrally embedded reflective surface that rotates between the horns. FIGS. 7C and 7D present top and front views, respectively, of an exemplary antenna utilizing a switch matrix to control distribution of electromagnetic energy to one of the four horns during rotation of the lens/mirror assembly. Referring now to FIGS. 7A and 7B, an exemplary antenna 70*a* comprises four horns 72*a*, 72*b*, 72*c*, and 72*d* and a cylindrical lens 74 having a centrally-embedded reflective surface 76 extending along the axis of the cylinder. The cylindrical lens 74 is positioned between the horns 72*a*, 72*b*, 72*c*, and 72*d* and can rotate over a range of 360 degrees in response to operation of a positioning system (not shown), such as an open-loop, stepper motor or servomotor. Pairs of the horns 72 are positioned opposite each other: horn 72*a* is placed opposite horn 72*b* and horn 72*c* is placed opposite horn 72*d*. The cylindrical lens 74 comprises a pair of half cylinders 74*a* and 74*b*, each comprising a dielectric material. The flat surface of each of the half cylinders 74*a* and 74*b* is positioned adjacent to a reflective side of the two-sided reflective surface 76.

Similar to the exemplary antenna described with respect to FIGS. 4B and 4C, a signal output by any of the four horns 72*a*, 72*b*, 72*c*, or 72*d* can be reflected by the rotating combination of the cylindrical lens 74 and reflective surface 76 to project an antenna beam in a desired angular position. Because all four horns can be simultaneously active, a scanning range of 360 degrees can be achieved by the antenna 70*a*. In particular, a 90 degree field-of-view can be continuously scanned by the exemplary antenna 70*a*.

Referring now to FIGS. 7C and 7D, an exemplary antenna 70*b* comprises four horns 71*a*, 71*b*, 71*c*, and 71*d*, and a cylindrical lens 75 comprising dielectric material and including a pair of embedded reflective surfaces 77 and 79. A switch 73 can control the distribution of electromagnetic energy to any one of the four horns 71*a*, 71*b*, 71*c*, or 71*d*. The horns 71*a* and 71*b* are placed adjacent to each other and positioned opposite a pair of adjacently positioned horns 71*c* and 71*d*. The pair of reflective surfaces 77 and 79, embedded within the cylindrical lens 75, are staggered in orientation by half of the desired field-of-view. For the exemplary antenna 70*b*, the reflective surface 77 has a slant of 45 degrees and the reflective surface 79 has a slant of −45 degrees. The exemplary antenna 70*b* can continuously scan a 90 degree field-of-view based on the constant rotation of the continuation of the cylindrical lens and the reflective surfaces 77 and 79 by a positioning system (not shown). Near instantaneous restart or fly-back can be accomplished by switching the distribution of electromagnetic energy between any one of the four horns 71*a*, 71*b*, 71*c*, or 71*d*.

Figure 8A:
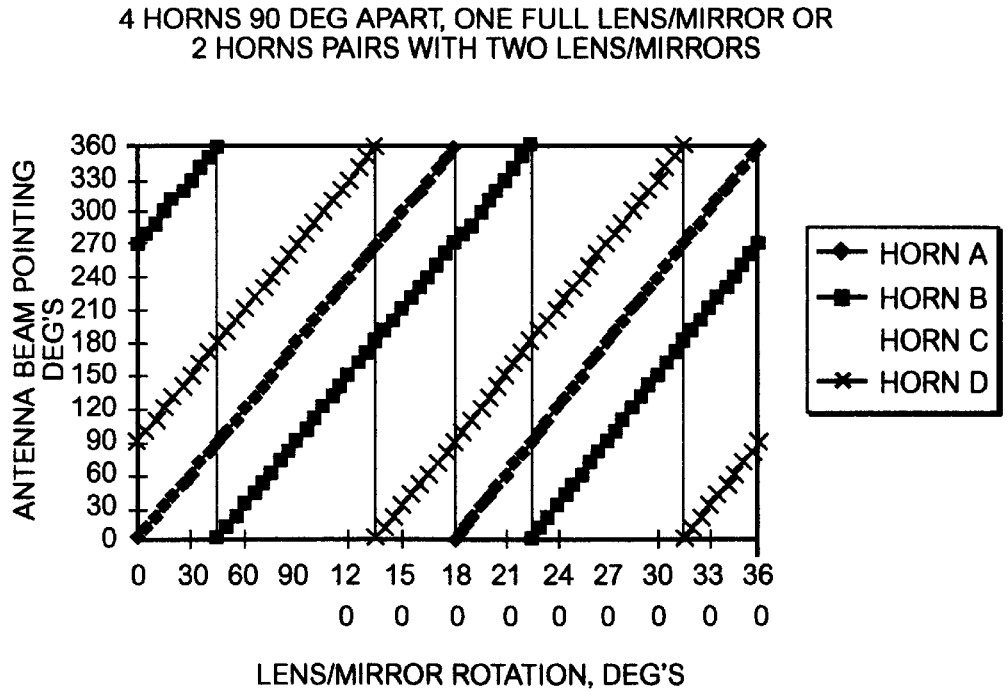
FIGS. 8A and 8B are diagrams that show scanning plots for exemplary antenna embodiments utilizing four horns and at least one rotating lens/mirror.
Figure 8B:
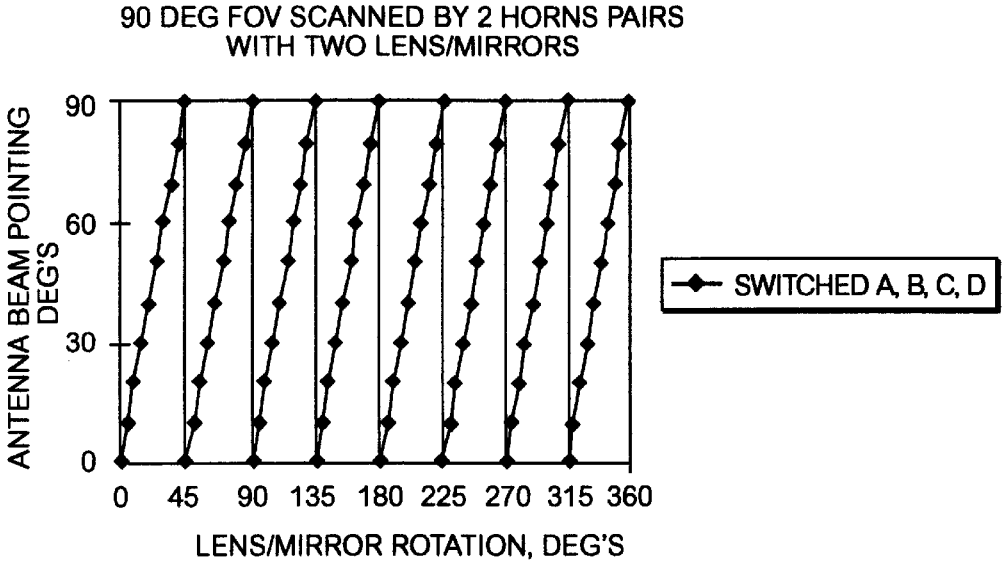

FIGS. 8A and 8B are diagrams showing scanning plots for the exemplary antennas 70*a* and 70*b* illustrated in FIGS. 7A and 7B and FIGS. 7C and 7D. FIG. 8A confirms that a 45 degree rotation of the combination of a cylindrical lens and a two-sided reflective surface placed between four horns can result in the constant scanning of a 90 degree field-of-view. FIG. 8B illustrates that a 90 degree field-of-view can be continuously scanned with near instantaneous reset capability by the rotation of a cylindrical lens including a pair of staggered reflective surfaces between a switched set of four horns.

FIGS. 9A, 9B, 9C, and 9D are diagrams that illustrate the use of a single horn and the combination of a half-cylinder lens and a reflective surface to provide an elevation over azimuth tracking antenna. An exemplary antenna 90 comprises a horn 92, a half-cylinder lens 94 of dielectric material, and a reflective surface 96 positioned adjacent to the flat surface of the lens 94. The antenna 90 can be enclosed within a low-height radome 98 to protect the antenna components from environmental effects. An elevation field-of-view can be scanned by rotating the combination of the half-cylinder lens 94 and the reflective surface 96 in front of the output of the horn 92. The antenna 90 can be placed on a positioning system 99, such as a 360 degree, rotating azimuth turntable, to support the scanning of an antenna beam within the azimuth plane.

Figure 9A:
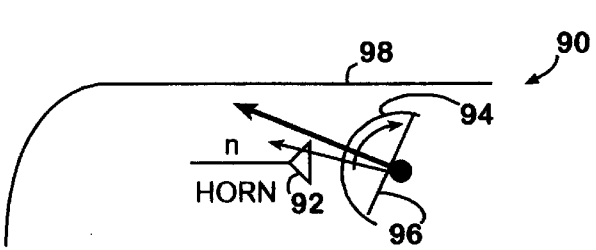
FIGS. 9A, 9B, 9C and 9D are diagrams that show an antenna sized to fit within a low height radome to provide an elevation-over-azinuth tracking antenna for mobile satellite communications in accordance with an exemplary embodiment of the present invention.
Figure 9B:
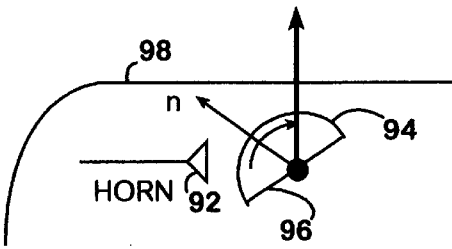
Figure 9C:
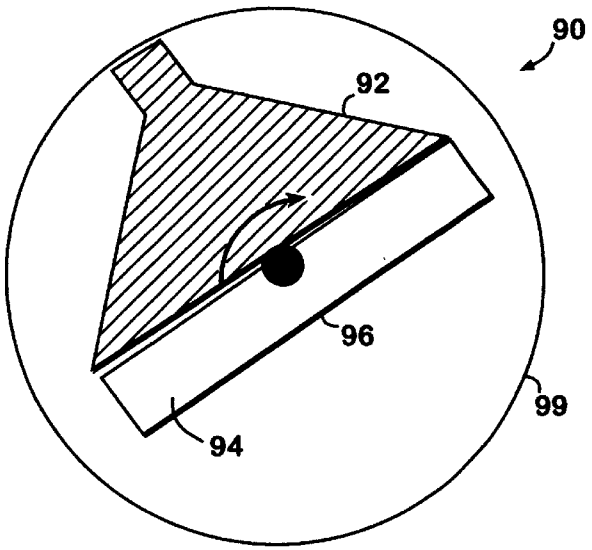
Figure 9D:
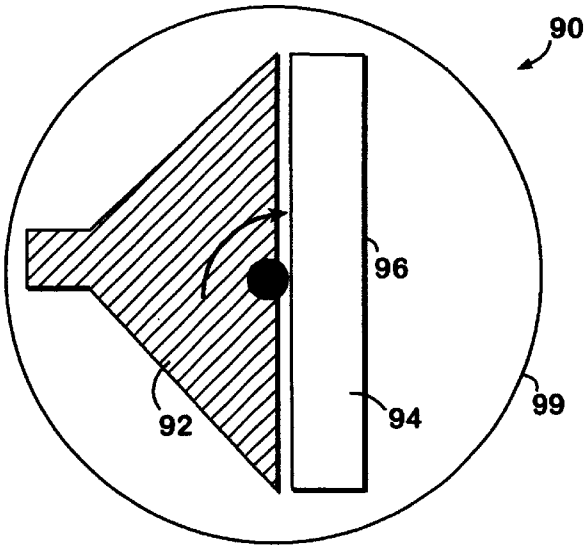

For example, FIG. 9A illustrates that an elevation beam can be scanned to 30 degrees in response to rotating the combination of the lens 94 and the reflective surface 96 15 degrees from the vertical plane. FIG. 9B illustrates that the elevation beam can be scanned to 90 degrees in response to rotating the combination of the lens 94 and the reflective surface 96 45 degrees from the vertical plane. FIGS. 9C and 9D illustrate the use of the antenna 90 to scan the azimuth plane based upon rotation of the antenna 90 by the positioning system 99, such as a 360 degree, rotating azimuth turntable.

Figure 10A:
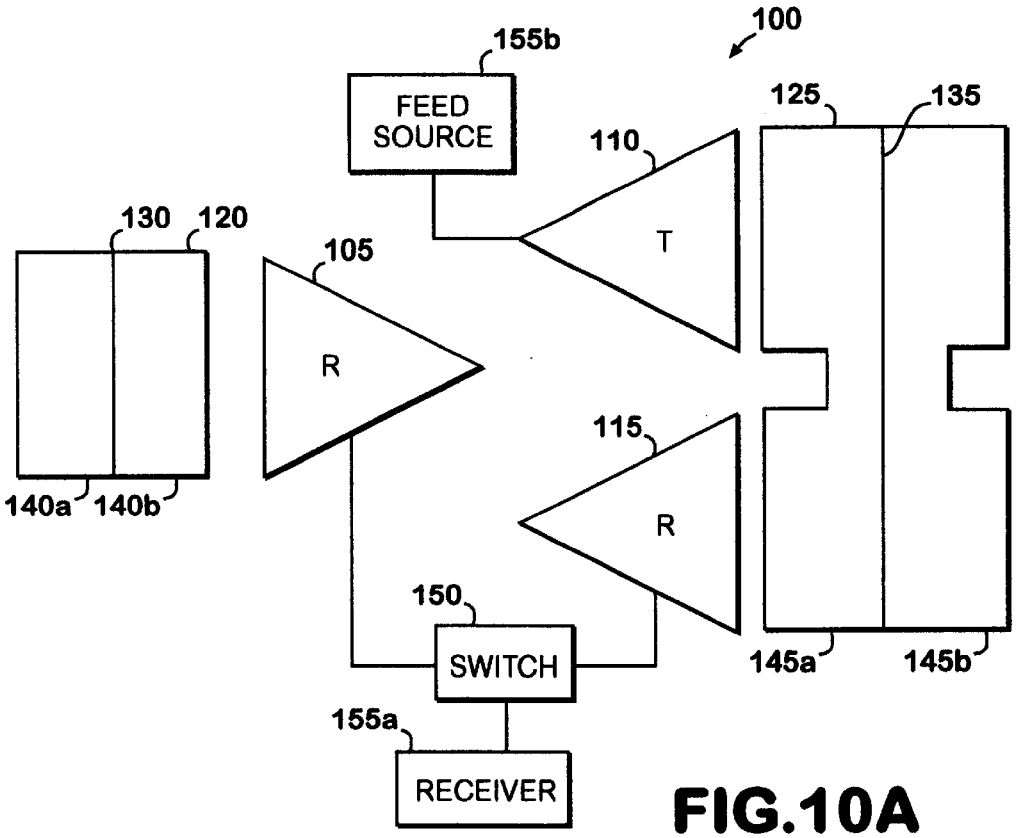
FIG. 10A is a block diagram illustrating an antenna system comprising a transmit antenna, a pair of receive antennas, a pair of cylindrical dielectric lenses, and a switch for switching a receiver between the pair of receive antennas, constructed in accordance with an exemplary embodiment of the present invention.
Figure 10B:
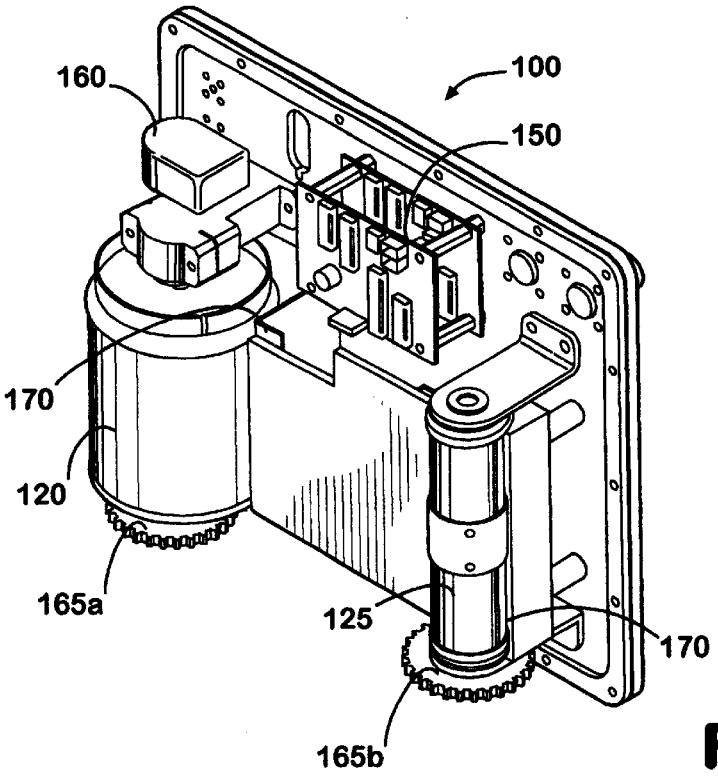
FIG. 10B is a diagram illustrating the use of an enclosure for enclosing selected components of the exemplary antenna system shown in FIG. 10A.

FIGS. 10A and 10B illustrate an alternative exemplary antenna system 100 comprising three antennas 105, 110 and 115, each containing an electromagnetic horn feeding radiation to a constant-K lens and mirror assembly 120 or 125. For another embodiment, each lens assembly also can be implemented using a Luneberg-type, graded dielectric lens with an accompanying mirror. Two semi-circular lenses 140*a* and 140*b* (145*a* and 145*b*) and both sides of a mirror 130 (135) are combined to yield a right-circular, cylinder-shaped structure for the lens assembly 120 (125). The first antenna's lens assembly 120 is driven directly by a motor 160 to scan the antenna beam in azimuth. The remaining two antennas 110 and 115 are arrayed vertically and employ the rotating lens and mirror assembly 125 on a common rotation axis. The antennas 110 and 115 are driven synchronously with the antenna 105 by means of a drive belt assembly 165*a* and 165*b* and a constant RPM motor 160. The antennas 110 and 115 are preferably aligned to provide coverage of the scanning angle that occurs simultaneous with the antenna 105. In this embodiment, the antenna system 100 provides a broad beam transmit antenna 110 and a broad beam receive antenna 115, and a narrow beam receive antenna 105. The desired receive aperture, either narrow beam or broad beam, may be selected via a switching network 150, by switching between the antennas 105 and 115.

The alternative exemplary antenna system 100 demonstrates a combination of multiple horn antennas and lens and mirror assemblies to achieve communication coverage for multiple axes. Narrow beam receive coverage, provided by the antenna 105 and the lens and mirror assembly 120, supports the detection of signals emitted by a target at a long range. In contrast, broad beam coverage, provided by the combination of the antenna 115 and the lens and mirror assembly 125, supports the detection of signals emitted by a target in a short range environment. The switching network 150 controls switching between the narrow beam or broad beam receive apertures and is typically implemented by an electronic switch. A receiver 155*a* is coupled to either the receive antenna 105 or the receive antenna 115 via the switch 150. A feed source 155*b* is coupled directly to the transmit antenna 110.

One or more enclosures 170, each comprising conductive material, can be installed as part of the housing for the antenna system 100 in the vicinity of the antennas 105, 110 and 115 to block undesirable or spurious electromagnetic radiation. For example, in a collision avoidance radar system, the enclosure 170 can be used to control stray electromagnetic radiation and thereby minimize spurious target responses. As best shown in FIG. 10B, the enclosure 170 fully encloses the length and the top face of each of the antennas 105, 110 and 115. The enclosure 170, however, does not block the output aperture of each antenna 105, 110, and 115. It will be understood by those skilled in the art that the enclosure 170 represents an optional element for the antenna system 100 and may not be required for all communication applications.

Figure 11A:
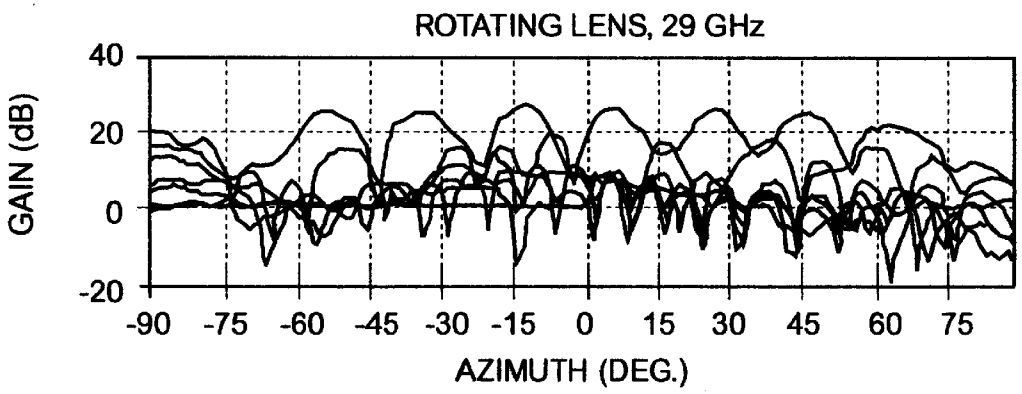
FIG. 11A is a diagram showing a scanning plot for an antenna system comprising a pair of horn antennas and a rotatable combination of a cylindrical dielectric lens and a reflective surface in accordance with an exemplary embodiment of the present invention.
Figure 11B:
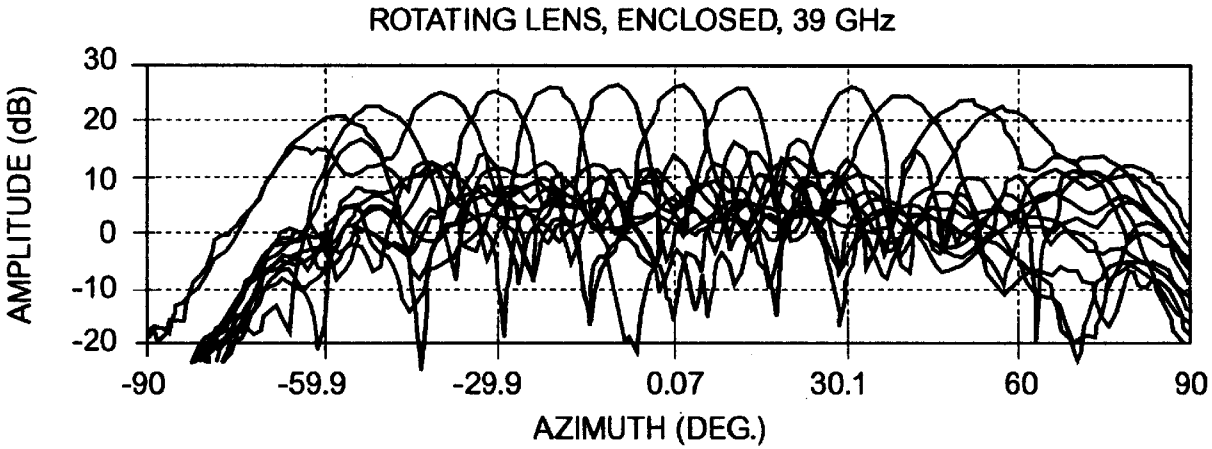
FIG. 11B is a diagram illustrating a scan plot for an antenna system comprising an enclosed pair of horn antennas in a rotatable combination of a cylindrical dielectric lens and a reflective surface in accordance with an alternative embodiment of the present invention.

FIGS. 11A and 11B are diagrams showing scan patterns for an exemplary antenna, such as the antenna illustrated in FIG. 10A, without an enclosure and with an enclosure, respectively. FIG. 11A illustrates the scan pattern generated by the combination of a pair of horn antennas and a rotating cylindrical lens and mirror assembly at 29 GHz in the azimuth plane. Neither horn is enclosed by an enclosure comprising conductive material to suppress undesired spurious radiation. FIG. 11B illustrates a scan pattern in the azimuth plane at 39 GHz for a pair of horn antennas, each enclosed by an enclosure of conductive material, and a rotating lens and mirror assembly. The enclosure operates to suppress the radiation of undesirable signals, such as spurious electromagnetic radiation, in an azimuth plane, as evidenced by a comparison of the scan patterns of FIGS. 11A and 11B. Both drawings illustrate multiple beams over approximately a 120 degree field-of-view. An enclosure typically comprises an absorptive material positioned adjacent to at least a portion of the conductive material to absorb the spurious electromagnetic radiation. For example, absorptive material can be affixed to interior portions of the enclosure that are exposed to the antenna radiation emissions.

In view of the foregoing, it will be appreciated that the invention provides an inventive antenna assembly including a rotating lens/reflective surface for scanning an antenna beam along a desired field-of-view. Although the antenna assembly of the present invention is typically implemented with horn antennas, other electromagnetic signal sources can be used in combination with the lens/reflective surface. For example, dipole elements provide an alternative radiating source for use with the inventive antenna assembly. The antenna also can include a sub-feed comprising a dielectric lens placed within the horn antenna to focus electromagnetic energy along the transmission axis and upon the lens/reflective surface. The lens/reflective surface can be implemented in the form of a semi-cylinder, comprising a lens of constant-K dielectric material and a reflective surface placed adjacent to the flat side coincident with the axis of the semi-cylinder. In the alternative, the lens/reflective surface can have the form of a cylinder comprising a constant-K dielectric material and a reflective surface embedded along the axis of the cylinder. A cylindrical Luneberg lens can be used in place of the cylindrical constant-K dielectric lens. It should be understood that the foregoing relates only to the exemplary embodiments of the present invention, and that numerous changes may be made therein without departing from the spirit and the scope of the invention.

What is claimed is:

1. An antenna, comprising:

a lens assembly, having the form of a semi-cylinder, comprising a lens and a reflective surface, the lens comprising a flat side coincident with the axis of the semi-cylinder and a curved semi-cylindrical surface centered upon said axis, the reflective surface positioned adjacent to the flat side of the lens and facing the curved semi-cylindrical surface of the lens;

a line source, located outside of the lens and in proximity to the curved semi-cylindrical surface of the lens, the line source being oriented substantially parallel to the axis of the semi-cylinder and operable to emit electromagnetic energy; and means for rotating the lens assembly about the axis of the semi-cylinder, thereby allowing the line source to scan a beam by reflecting electromagnetic energy from the reflective surface during rotation of the lens assembly.

2. The antenna of claim 1, wherein the lens comprises a constant-K dielectric lens.

3. The antenna of claim 1, wherein the lens comprises a Luneberg lens.

4. The antenna of claim 1, wherein the line source comprises a horn antenna having an output aperture for transmitting a beam of electromagnetic energy, the output aperture positioned proximate to the curved semi-cylindrical surface of the lens, thereby placing the lens within the transmission axis of the beam of electromagnetic energy.

5. The antenna of claim 4 wherein the means for rotating the lens is operable to rotate the lens about the axis of the semi-cylinder over a range of 90 degrees, thereby allowing the line source to scan the beam of electromagnetic energy over a range of approximately 180 degrees.

6. The antenna of claim 1 further comprising:

a second lens assembly, having the form of a semi-cylinder, comprising a lens and a reflective surface, the lens comprising a flat side coincident with the axis of the semi-cylinder and a curved semi-cylindrical surface centered upon said axis, the reflective surface positioned adjacent to the flat side of the lens, the flat side of second lens assembly positioned adjacent to the flat side of the lens assembly to form a cylindrical lens assembly;

a second line source located outside and in proximity to the curved semi-cylindrical surface of the lens of the second lens assembly, the second line source being oriented substantially parallel to the axis of the semi-cylinder of the second lens assembly and operable to emit electromagnetic energy, the cylindrical lens assembly formed by the lens assembly and the second lens assembly and positioned between the line source and the second line source, wherein the rotating means is operative to rotate the cylindrical lens, thereby enabling the line source to scan a beam by reflecting electromagnetic energy from the reflective surface during rotation of the cylindrical lens and enabling the second line source to scan a beam by reflecting electromagnetic energy from the reflective surface of the second lens assembly during rotation of the cylindrical lens assembly.

7. The antenna of claim 1, wherein the line source is a first line source, the antenna further comprising a second line source, and a switch for switching the coupling of a feed source between either the first line source or the second line source, wherein the first line source is operative to emit electromagnetic energy when the switch couples the first line source to the feed source and the second line source is operative to emit electromagnetic energy when the switch couples the second line source to the feed source.

8. The antenna of claim 1 further comprising an enclosure of conductive material covering a portion of the line source to reduce spurious electromagnetic radiation during rotation of the lens assembly.

9. The antenna of claim 8, wherein the enclosure further comprises an absorptive material positioned adjacent to at least a portion of the conductive material to absorb the spurious electromagnetic radiation.

10. The antenna of claim 1, wherein the line source comprises a parallel-plate antenna and a sub-feed comprising a lens of dielectric material for focusing electromagnetic energy upon the lens assembly, the sub-feed positioned within the parallel-plate structure of the parallel-plate antenna.

11. An antenna, comprising:

a lens assembly comprising a cylindrical lens and a reflective surface embedded within the cylindrical lens, the reflective surface comprising a reflective material facing the curved surface of the cylindrical lens and positioned along the central axis of the, cylindrical lens;

a first line source, located outside of the cylindrical lens and in proximity to the curved surface of the cylindrical lens, the first line source being oriented substantially parallel to the axis of the cylindrical lens and operable to emit electromagnetic energy;

a second line source, located outside of the cylindrical lens and in proximity to the curved surface of the cylindrical lens, the second line source being oriented substantially parallel to the axis of the cylindrical lens and operable to emit electromagnetic energy, the second line source positioned opposite the first line source;

means for rotating the cylindrical lens about its central axis; and a switch for switching between the first line source and the second line source, the first line source operative to scan a beam by reflecting electromagnetic energy from the reflective surface during rotation of the lens assembly when the first line source is selected by the switch, the second line source operative to scan a beam by reflecting electromagnetic energy from the reflective surface during rotation of the lens assembly when the second line source is selected by the switch.

12. The antenna of claim 11, wherein the cylindrical lens comprises one of a constant-K dielectric lens and a Luneberg lens.

13. The antenna of claim 11 wherein the means for rotating the lens is operable to rotate the lens about the axis of the semi-cylinder over a range of 180 degrees, thereby allowing the combination of the first line source and the second line source to scan a beam of electromagnetic energy over a range of approximately 360 degrees.

14. An antenna, comprising:

a first lens assembly comprising a cylindrical lens and a reflective surface embedded within the cylindrical lens, the reflective surface comprising a reflective material facing the curved surface of te cylindrical lens and positioned along the central axis of the cylindrical lens;

a second lens assembly comprising a cylindrical lens and a reflective surface embedded within the cylindrical lens, the reflective surface comprising a reflective material facing the curved surface of the cylindrical lens and positioned along the central axis of the cylindrical lens, the cylindrical lens of the second lens assembly having lens characteristics different from the cylindrical lens of the first lens assembly;

a transmit antenna, located outside of the first cylindrical lens assembly and in proximity to the curved surface of the first cylindrical lens assembly, the transmit antenna being oriented substantially parallel to the axis of the first cylindrical lens assembly and operable to emit electromagnetic energy;

a first receive antenna, located outside of the first cylindrical lens assembly and in proximity to the curved surface of the first cylindrical lens assembly, the first receive antenna being oriented substantially parallel to the axis of the first cylindrical lens assembly and operable to receive electromagnetic energy;

a second receive antenna;

means for synchronously rotating the first cylindrical lens about its central axis and the second cylindrical lens about its central axis; and a switch for switching between the first receive antenna and the second receive antenna, the first receive antenna operative to scan a broad beam by in response to reflected electromagnetic energy from the reflective surface during rotation of the first lens assembly when the first receive antenna is selected by the switch, the second receive antenna operative to scan a narrow beam by in response to reflected electromagnetic energy from the reflective surface during rotation of the second lens assembly when the second receive antenna is selected by the switch.

15. The antenna of claim 14 further comprising an enclosure of conductive material covering at least a portion of the transmit antenna and the first and second receive antennas to reduce spurious electromagnetic radiation during rotation of the first and second lens assemblies.

16. The antenna of claim 15, wherein the transmit antenna comprises a parallel-plate antenna and a sub-feed comprising a lens of dielectric material for focusing electromagnetic energy upon the first lens assembly, the sub-feed positioned within the parallel-plate structure of the parallel-plate antenna.

17. An antenna system, comprising:

a lens assembly comprising a cylindrical lens and a reflective surface embedded within the cylindrical lens, the reflective surface comprising a reflective material facing the curved surface of the cylindrical lens and positioned along the central axis of the cylindrical lens;

a plurality of antennas, located outside of the cylindrical lens and in proximity to the curved surface of the cylindrical lens, each antenna being oriented substantially parallel to the axis of the cylindrical lens and operable to communicate electromagnetic energy;

means for rotating the lens assembly about the central axis of the cylindrical lens; and a switch for switching between any pair of opposing antennas, a first one of the pair of antennas operative to scan a beam by reflecting electromagnetic energy from the reflective surface during rotation of the lens assembly when the first antenna is selected by the switch, the second one of the pair of antennas operative to scan a beam by reflecting electromagnetic energy from the reflective surface during rotation of the lens assembly when the second antenna is selected by the switch.

18. A process for scanning a field-of-view, comprising the steps of:

rotating a lens assembly about its axis, the lens assembly comprising a cylindrical lens and a reflective surface embedded within the cylindrical lens, the reflective surface comprising a reflective material facing the curved surface of the cylindrical lens and positioned along the central axis of the cylindrical lens;

switching between a first antenna and a second antenna positioned opposite the first antenna, the lens assembly between and proximate to the first and the second antennas, the first antenna operative to scan a beam by reflecting electromagnetic energy from the reflective surface during rotation of the lens assembly in response to selection of the first antenna, the second antenna operative to scan a beam by reflecting electromagnetic energy from the reflective surface during rotation of the lens assembly in response to selection of the second antenna.

19. An antenna, comprising:

a lens assembly, having the form of a semi-cylinder, comprising a lens and a reflective surface, the lens comprising a flat side coincident with the axis of the semi-cylinder and a curved semi-cylindrical surface centered upon said axis, the reflective surface positioned adjacent to the flat side of the lens and facing the curved semi-cylindrical surface of the lens;

a horn antenna, located outside of the lens and in proximity to the curved semi-cylindrical surface of the lens, the horn antenna being oriented substantially parallel to the axis of the semi-cylinder and operable to emit electromagnetic energy;

means for rotating the lens assembly about the axis of the semi-cylinder, thereby allowing the horn antenna to scan a beam in the elevation plane by reflecting electromagnetic energy from the reflective surface during rotation of the lens assembly; and means for rotating the combination of the lens assembly and the horn antenna, thereby allowing the horn antenna to scan a beam in the azimuth plane by reflecting electromagnetic energy from the reflective surface during simultaneous rotation of the lens assembly and the combination of the lens assembly and the horn antenna.

20. The antenna of claim 19, wherein the means for rotating the lens assembly comprises a rotating motor having a belt drive coupled to the lens assembly; and the means for rotating the combination of the lens assembly and the horn antenna comprises a positioning system.

* * * * *